US010479097B2

(12) United States Patent
Katakura et al.

(10) Patent No.: US 10,479,097 B2
(45) Date of Patent: Nov. 19, 2019

(54) LIQUID EJECTING APPARATUS

(71) Applicant: SEIKO EPSON CORPORATION, Tokyo (JP)

(72) Inventors: Takahiro Katakura, Okaya (JP); Shinichi Nakamura, Okaya (JP); Junichi Sano, Chino (JP); Hirofumi Sakai, Shiojiri (JP); Keigo Sugai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/046,886

(22) Filed: Jul. 26, 2018

(65) Prior Publication Data

US 2019/0030904 A1 Jan. 31, 2019

(30) Foreign Application Priority Data

Jul. 27, 2017 (JP) ..... 2017-145024

(51) Int. Cl.
*B41J 2/175* (2006.01)
*B41J 2/14* (2006.01)

(52) U.S. Cl.
CPC ..... *B41J 2/17523* (2013.01); *B41J 2/14274* (2013.01); *B41J 2/175* (2013.01); *B41J 2/17596* (2013.01); *B41J 2202/05* (2013.01); *B41J 2202/12* (2013.01)

(58) Field of Classification Search
CPC .... B41J 2/17523; B41J 2/14274; B41J 2/175; B41J 2/17596; B41J 2202/12; B41J 2202/05
See application file for complete search history.

(56) References Cited

U.S. PATENT DOCUMENTS 4,413,267 A * 11/1983 Hein ..... B41J 2/175 347/89
2008/0238980 A1* 10/2008 Nagashima ..... B41J 2/14233 347/17
2011/0169897 A1* 7/2011 Yokoyama ..... B41J 2/055 347/70
2011/0228012 A1 9/2011 Yoshida et al.

FOREIGN PATENT DOCUMENTS

JP 06-008467 A 1/1994
JP 06-024000 A 2/1994
JP 06-143601 A 5/1994
JP 06-143602 A 5/1994
JP 2011-088435 A 5/2011
JP 2011-213094 A 10/2011

* cited by examiner

*Primary Examiner* — Yaovi M Ameh
(74) *Attorney, Agent, or Firm* — Workman Nydegger

(57) ABSTRACT

A liquid ejecting apparatus includes a liquid chamber that is in communication with a nozzle that ejects liquid, a volume changing device that changes volume of the liquid chamber, an inflow channel that is connected to the liquid chamber and enables the liquid to flow into the liquid chamber, a discharge channel that discharges the liquid, a first flow path resistance changing device that changes flow path resistance of the inflow channel, a liquid supply section that supplies the liquid to the inflow channel by pressurizing the liquid, and a bypass channel that enables the liquid supplied from the liquid supply section to bypass the inflow channel and to flow into the discharge channel.

6 Claims, 5 Drawing Sheets

| | |
|---|---|
| (1) STANDBY STEP |  |
| (2) FILLING STEP |  |
| (3) EJECTION STEP |  |
| (4) SEPARATION STEP |  |

LIQUID EJECTING APPARATUS

BACKGROUND

1. Technical Field

The present invention relates to a liquid ejecting apparatus.

2. Related Art

An example of a liquid ejecting apparatus that ejects liquid is described in JP-A-2011-213094. This apparatus ejects ink from a nozzle by using an actuator that changes the volume of an ink chamber that is in communication with the nozzle.

In the apparatus according to JP-A-2011-213094, the pressure of ink (i.e., liquid) supplied to the ink chamber needs to be lower than a meniscus pressure resistance of the nozzle so that the nozzle is prevented from spilling ink when the nozzle does not eject liquid, which makes the apparatus incapable of applying a high pressure to ink. This makes it difficult for the apparatus according to JP-A-2011-213094, for example, to fill the ink chamber with a high-viscosity liquid at a high speed during a supply phase by applying a high pressure. To increase the ink supply pressure while suppressing spillage of ink from the nozzle, the inventors studied an approach to provide a valve at the mouth of the ink chamber and close the valve when the nozzle is not ejecting liquid. However, it is difficult to completely cut ink flow by using the valve. This leads to another problem that when a high pressure is applied to ink in the ink supply phase, the ink may be spilled to the ink chamber through the valve and consequently spilled from the nozzle. It is desirable to provide a technique that enables the use of a high-viscosity liquid while suppressing spillage of liquid from a nozzle.

SUMMARY

The invention can be implemented in forms described below.

A liquid ejecting apparatus according to an aspect of the invention includes a liquid chamber that is in communication with a nozzle that ejects liquid, a volume changing device that changes volume of the liquid chamber, an inflow channel that is connected to the liquid chamber and enables the liquid to flow into the liquid chamber, a discharge channel that discharges the liquid, a first flow path resistance changing device that changes flow path resistance of the inflow channel, a liquid supply section that supplies the liquid to the inflow channel by pressurizing the liquid, and a bypass channel that enables the liquid supplied from the liquid supply section to bypass the inflow channel and to flow into the discharge channel. In the liquid ejecting apparatus having this configuration, when the first flow path resistance changing device increases the flow path resistance of the inflow channel, the liquid supplied under pressure can flow through the bypass channel. This suppresses spillage of the liquid from the inflow channel to the liquid chamber while the flow path resistance of the inflow channel is high. This enables a high-viscosity liquid to fill the liquid chamber at a high speed, and the spillage of the liquid from the nozzle can be suppressed.

It is preferable that the liquid ejecting apparatus further include an outflow channel that is connected to the liquid chamber and enables the liquid to flow from the liquid chamber to the discharge channel. The liquid ejecting apparatus having this configuration can restrain sedimentable components of liquid from accumulating within the liquid chamber and can discharge bubbles trapped in the liquid chamber.

It is preferable that the liquid ejecting apparatus further include a second flow path resistance changing device that changes flow path resistance of the outflow channel. The liquid ejecting apparatus having this configuration can efficiently increase the pressure within the liquid chamber by increasing the flow path resistance of the outflow channel when the liquid is ejected.

It is preferable that the liquid ejecting apparatus further include a third flow path resistance changing device that changes flow path resistance of the bypass channel. The liquid ejecting apparatus having this configuration can fill the liquid chamber with liquid efficiently by increasing the flow path resistance of the bypass channel while filling the liquid chamber with liquid.

It is preferable that in the liquid ejecting apparatus, the liquid supply section be a metering pump. The liquid ejecting apparatus having this configuration can use a high-viscosity liquid with a simple structure while reducing the likelihood of liquid spilling from the nozzle.

The invention can be implemented in various configurations other than the liquid ejecting apparatus described above. For example, the invention can be implemented in a configuration of using a liquid ejecting method executed by the liquid ejecting apparatus, a computer program for controlling the liquid ejecting apparatus, and a non-volatile and tangible recording media in which the computer program is stored.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
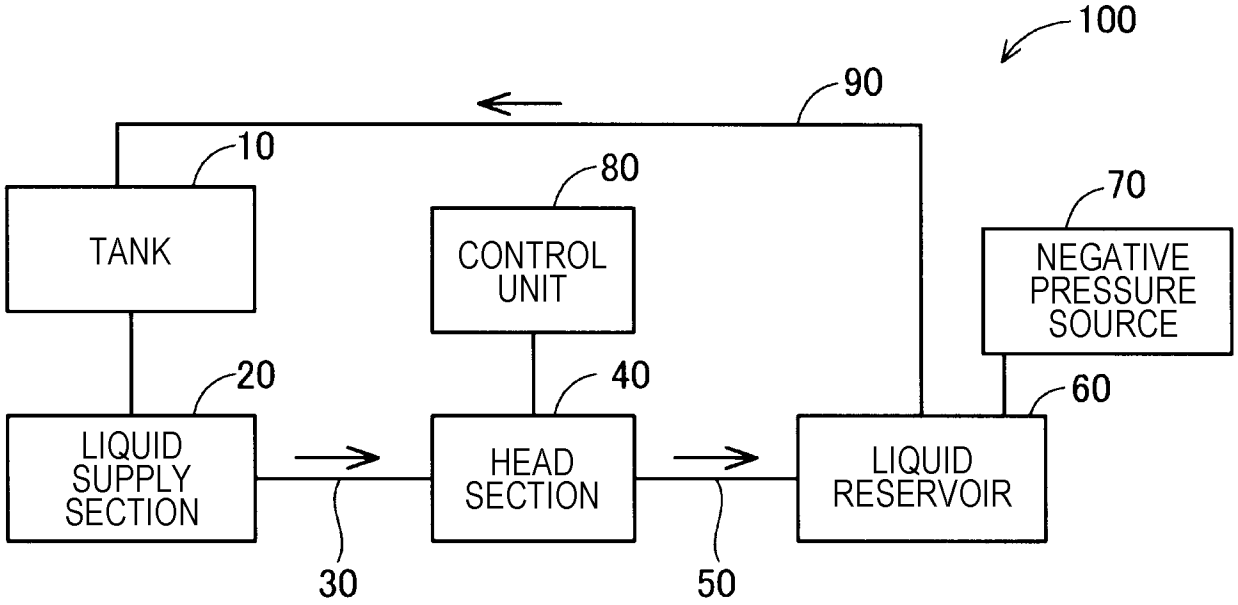
FIG. 1 is a diagram schematically illustrating a structure of a liquid ejecting apparatus according to a first embodiment.

FIG. 1 is a diagram schematically illustrating a structure of a liquid ejecting apparatus 100 according to a first embodiment of the invention. The liquid ejecting apparatus 100 includes a tank 10, a liquid supply section 20, a supply channel 30, a head section 40, a discharge channel 50, a liquid reservoir 60, a negative pressure source 70, and a control unit 80.

The tank 10 contains a liquid. An example of the liquid is an ink having a predetermined viscosity. The liquid in the tank 10 is pressurized by the liquid supply section 20 and supplied to the head section 40 through the supply channel 30. The liquid supply section 20 according to the present embodiment is a metering pump that can supply liquid at a constant flow rate. A gear pump, which enables less pulsating delivery, can be adopted as the metering pump. Alternatively, for example, various types of metering pumps, such as a diaphragm-type pump or a plunger-type pump, may be used with a buffer tank installed in the supply channel 30 to absorb pulsation.

The liquid supplied to the head section 40 through the supply channel 30 is ejected by the head section 40. Operation of the head section 40 is controlled by the control unit 80. The control unit 80 is realized as a computer having a CPU and a memory. The CPU executes a program stored in the memory to control the operation of the head section 40. The program may be stored in a tangible non-volatile recording medium.

The liquid that has not been ejected by the head section 40 is discharged to the liquid reservoir 60 through the discharge channel 50. The negative pressure source 70 is connected to the liquid reservoir 60. The negative pressure source 70 can be realized by using any suitable type of pump. The negative pressure source 70 sucks liquid from the head section 40 through the discharge channel 50 by applying a negative pressure to the inside of the liquid reservoir 60. Thus, in the embodiment, the liquid that has not been ejected from the head section 40 is discharged from the head section 40 to the discharge channel 50, which can restrain sedimentable components in the liquid from accumulating within the head section 40. Note that the negative pressure source 70 may be omitted.

In the embodiment, the liquid reservoir 60 and the tank 10 are connected to each other by a circulation channel 90. The liquid stored in the liquid reservoir 60 is returned to the tank 10 through the circulation channel 90 and supplied again to the head section 40 through the liquid supply section 20. A pump for sucking liquid from the liquid reservoir 60 may be installed in the circulation channel 90. A foreign matter filter and a deaerator module may also be installed in the circulation channel 90. Alternatively, it is possible to adopt a configuration in which the circulation channel 90 is omitted and the liquid ejecting apparatus 100 does not circulate liquid.

Figure 2:
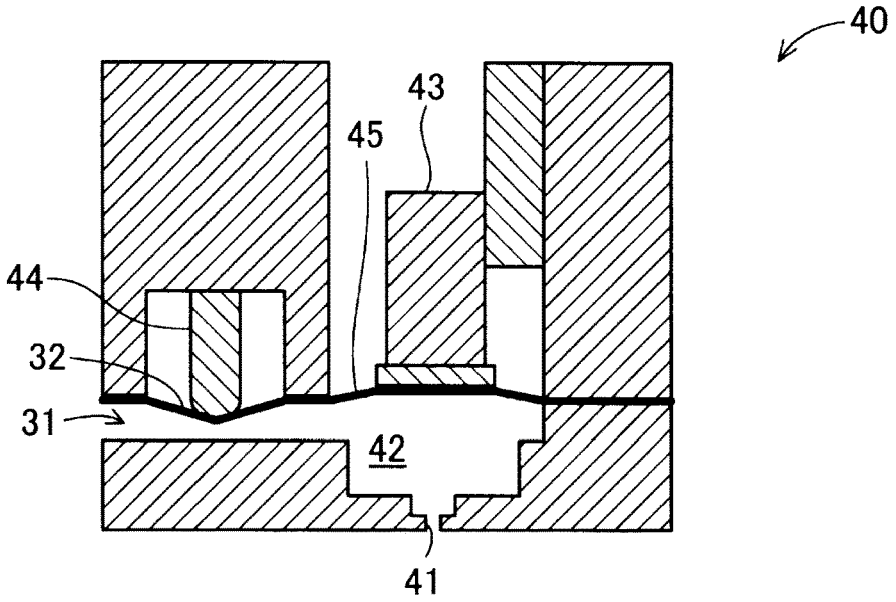
FIG. 2 is a first diagram schematically illustrating a structure of a head section.

FIG. 2 is a first diagram schematically illustrating a structure of a head section 40. A bottom area in the image of FIG. 2 represents a downward region in the gravity direction. The head section 40 includes a nozzle 41, a liquid chamber 42, a volume changing device 43, and a first flow path resistance changing device 44. The liquid chamber 42 is a chamber to which liquid is supplied. The liquid chamber 42 is in communication with the nozzle 41 through which liquid is ejected. An inflow channel 31 through which liquid flows into the liquid chamber 42 is connected to the liquid chamber 42. Liquid flows from the supply channel 30 (FIG. 1) to the inflow channel 31.

A ceiling 45 of the liquid chamber 42 is formed of a member that can deform elastically, such as a diaphragm or a rubber membrane. The volume changing device 43 for changing the volume of the liquid chamber 42 is disposed on the upper side of the ceiling 45. The volume changing device 43 can change the volume of the liquid chamber 42 by displacing the ceiling 45 in the up-down direction. In the embodiment, a piezo-actuator that can be elongated in the up-down direction is used as the volume changing device 43.

In the embodiment, part of a ceiling 32 of the inflow channel 31 is formed of a member that can deform elastically, such as a diaphragm or a rubber membrane. The first flow path resistance changing device 44 for changing the flow path resistance of the inflow channel 31 is disposed on the upper side of the ceiling 32. The first flow path resistance changing device 44 can change the cross section of the inflow channel 31 by displacing the ceiling 32 in the up-down direction. In the embodiment, a piezo-actuator that can be elongated in the up-down direction is used as the first flow path resistance changing device 44. The structure of the head section 40 illustrated in FIG. 2 is hereinafter referred to as the "ejection structure".

Figure 3:
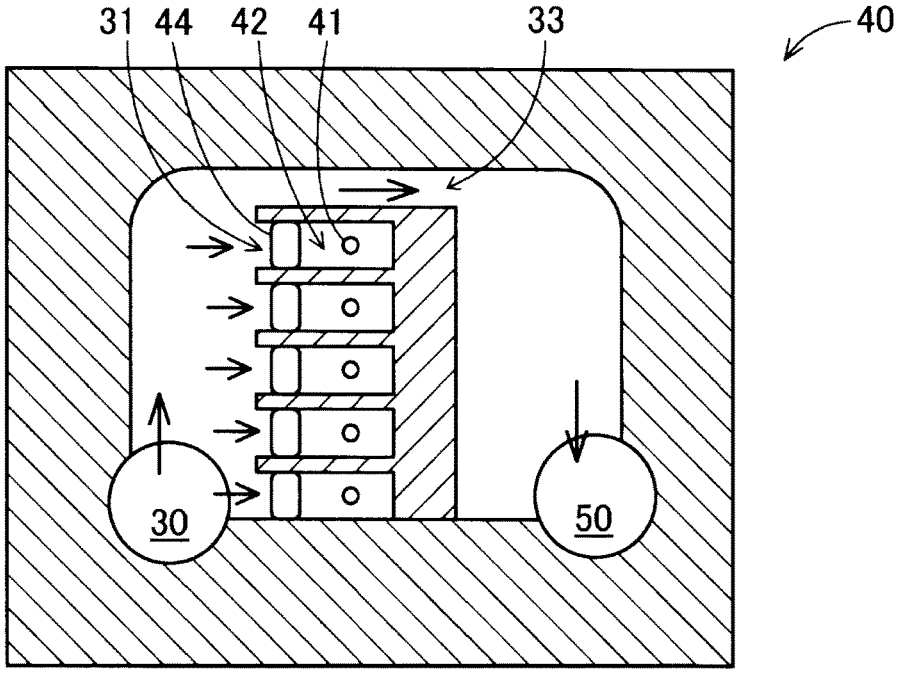
FIG. 3 is a second diagram schematically illustrating the structure of the head section.

FIG. 3 is a second diagram schematically illustrating the structure of the head section 40. The depth direction, which is perpendicular to the image of FIG. 3, represents the gravity direction. As illustrated in FIG. 3, the head section 40 according to the embodiment includes a plurality of the ejection structures, each of which is illustrated in FIG. 2. More specifically, five ejection structures, each of which includes the first flow path resistance changing device 44, the liquid chamber 42, and the nozzle 41, are disposed adjacently in a horizontal direction in the head section 40. The inflow channels 31 connected to respective liquid chambers 42 are also connected to the common supply channel 30. In other words, in the embodiment, the single supply channel 30 branches into five inflow channels 31.

In the embodiment, a bypass channel 33 is connected to the supply channel 30. The bypass channel 33 is a fluid channel that allows liquid supplied from the liquid supply section 20 to bypass the inflow channels 31 and flow into the discharge channel 50. In the embodiment, liquid flows continuously through the bypass channel 33, regardless of whether or not the nozzles 41 eject liquid. The flow path resistance of the bypass channel 33 is set higher than the combined flow path resistance of the inflow channels 31 when the first flow path resistance changing devices 44 minimize the respective flow path resistance of each of the inflow channels 31, and, at the same time, the flow path resistance of the bypass channel 33 is set lower than the combined flow path resistance of the inflow channels 31 when the first flow path resistance changing devices 44 maximize the respective flow path resistance of each of the inflow channels 31.

Figure 4:
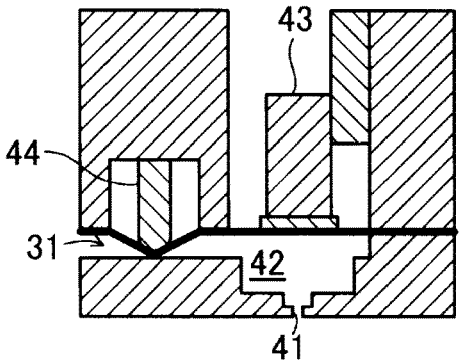
FIG. 4 is a process chart illustrating control items of ejection control performed by a control unit.
Figure 4:
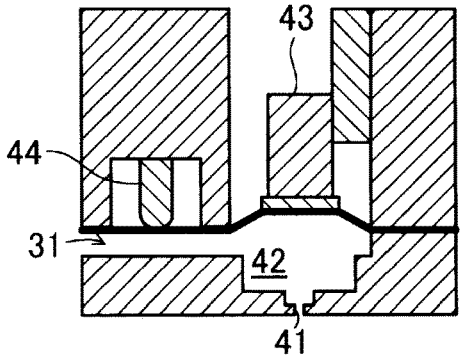
Figure 4:
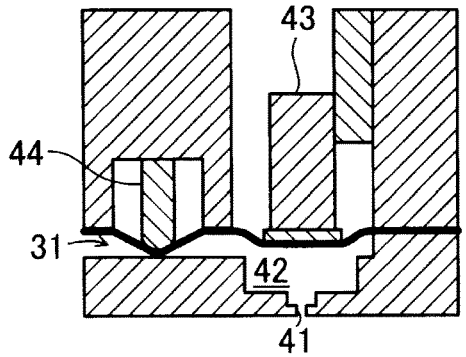
Figure 4:
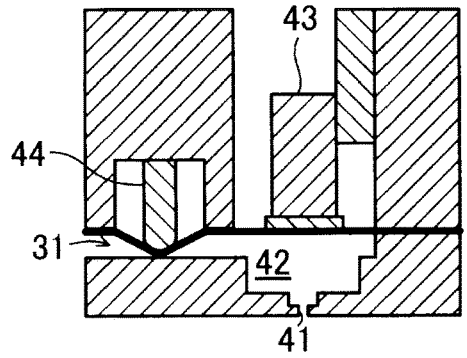

FIG. 4 is a process chart illustrating control items of ejection control performed by a control unit 80. In a standby step in which liquid is not ejected, the control unit 80 closes each inflow channel 31 by controlling the first flow path resistance changing device 44 so as to increase the flow path resistance of the inflow channel 31. In the present embodiment, the bypass channel 33 is disposed in the head section 40 (FIG. 3). Thus, in the standby step, the liquid supplied from the supply channel 30 to the head section 40 does not flow into each inflow channel 31 but flows into the bypass channel 33 and is discharged via the discharge channel 50.

Subsequently, the control unit 80 performs a filling step in which liquid is filled into each liquid chamber 42. In the filling step, the control unit 80 decreases the flow path resistance of the inflow channel 31 by controlling the first flow path resistance changing device 44 and subsequently increases the volume of the liquid chamber 42 by controlling the volume changing device 43. As a result, the liquid chamber 42 is filled with liquid. Although a portion of the liquid continues to flow through the bypass channel 33 during the filling step, the flow rate of the liquid flowing through the bypass channel 33 is less than that in the standby step because the flow path resistance of the bypass channel 33 is set higher than the combined flow path resistance of the inflow channels 31.

After the liquid chamber 42 is filled with liquid in the filling step, the control unit 80 performs an ejection step. In the ejection step, the control unit 80 increases the flow path resistance of the inflow channel 31 by controlling the first flow path resistance changing device 44, and subsequently decreases the volume of the liquid chamber 42 by controlling the volume changing device 43. As a result, the pressure in the liquid chamber 42 increases. When the pressure in the liquid chamber 42 exceeds a meniscus pressure resistance within the nozzle 41, liquid is ejected from the nozzle 41. In the embodiment, the volume of the liquid chamber 42 is reduced after the flow path resistance of the inflow channel 31 is increased, which enables the pressure within the liquid chamber 42 to increase efficiently. Liquid continues to flow through the bypass channel 33 during this ejection step.

After liquid is ejected from the liquid chamber 42 in the ejection step, the control unit 80 performs a separation step. In the separation step, the control unit 80 increases the volume of the liquid chamber 42 to a level equivalent to that in the standby step by controlling the volume changing device 43 while maintaining the state of a high flow path resistance of the inflow channel 31. This releases the pressure in the liquid chamber 42 that has been increased in the ejection step, which enables the liquid ejected from the nozzle 41 to be efficiently separated from the liquid in the liquid chamber 42. Liquid continues to flow through the bypass channel 33 during the separation step. This separation step can be omitted when the viscosity of liquid is such that the liquid does not leave a trail in the ejection step. The control unit 80 can consecutively eject liquid droplets from the nozzle 41 by performing the above steps repeatedly.

In the liquid ejecting apparatus 100 according to the present embodiment described above, the bypass channel 33 is disposed in the head section 40. Accordingly, when liquid is not ejected, liquid bypasses the inflow channels 31 of which the respective flow path resistance is increased, and the liquid is discharged through the bypass channel 33. This arrangement makes it possible to increase the pressure of liquid supplied to the head section 40. The liquid chambers 42 can be thereby filled with a high-viscosity liquid quickly. Moreover, even if the inflow channels 31 are not completely closed by the first flow path resistance changing devices 44, liquid flows through the bypass channel 33 of which the flow path resistance is lower than that of the inflow channels 31. This reduces the likelihood of liquid entering the liquid chambers 42 and spilling from the nozzles 41. In other words, the liquid ejecting apparatus 100 according to the embodiment enables ejection of a high-viscosity liquid at a high frequency, while reducing the likelihood of liquid spilling from the nozzles 41 and thereby implementing a stable ejection cycle.

Note that in the embodiment, the pressure of liquid applied to the mouth of each inflow channel 31 increases as the flow path resistance of the bypass channel 33 increases and as the flow rate in the liquid supply section 20 (metering pump) increases. Thus, the flow path resistance of the bypass channel 33 and the flow rate of the metering pump are set such that the pressure of liquid applied to the mouth of each inflow channel 31 does not exceed the meniscus pressure resistance of the nozzle 41 irrespective of the flow path resistance of the inflow channel 31. As a result, liquid spillage from the nozzle can be suppressed with a simple structure without providing a pressure sensor or a mechanism for controlling the pressure of liquid precisely.

Second Embodiment

Figure 5:
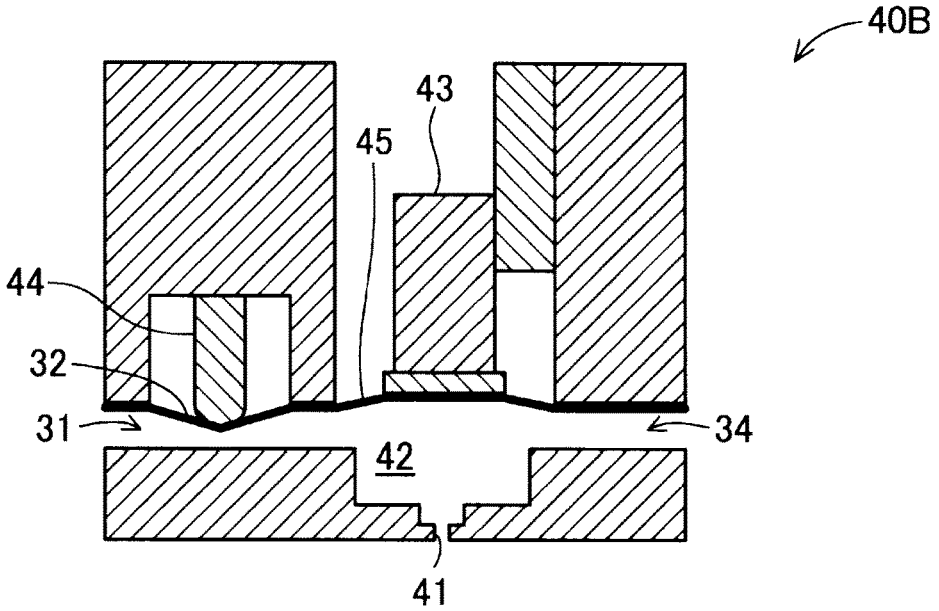
FIG. 5 is a first diagram schematically illustrating a structure of a head section according to a second embodiment.
Figure 6:
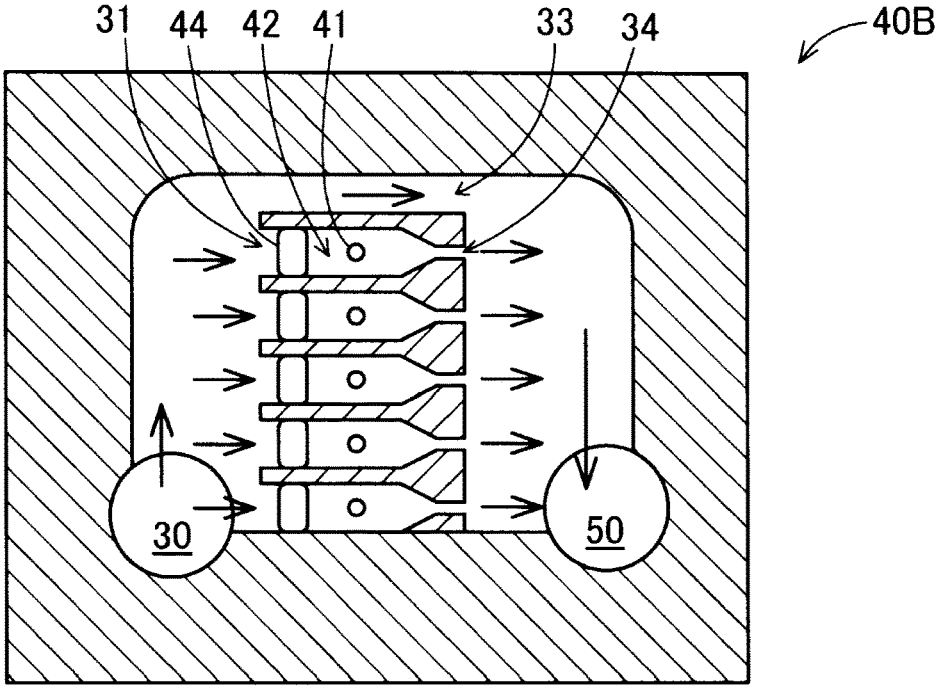
FIG. 6 is a second diagram schematically illustrating the structure of the head section according to the second embodiment.

FIG. 5 is a first diagram schematically illustrating a structure of a head section 40B according to the second embodiment. FIG. 6 is a second diagram schematically illustrating the structure of the head section 40B according to the second embodiment. The head section 40B according to the second embodiment is different from the head section 40 in the first embodiment in that an outflow channel 34 connected to each of the liquid chambers 42. The outflow channel 34 is a fluid channel that is connected to each liquid chamber 42 and allows liquid to flow from the liquid chamber 42 into the discharge channel 50. The flow path resistance of the outflow channel 34 is set substantially higher than the flow path resistance of the liquid chamber 42.

According to the second embodiment, the liquid chamber 42 and the discharge channel 50 are in communication with each other through the outflow channel 34. The liquid within the liquid chamber 42 is ejected from the nozzle 41, while a certain amount of the liquid is discharged from the outflow channel 34. This can restrain sedimentable components of liquid from accumulating within the liquid chamber 42 and can discharge bubbles trapped in the liquid chamber 42 to the discharge channel 50. Clogging or ejection failure of the nozzle 41 can be thereby suppressed.

Third Embodiment

Figure 7:
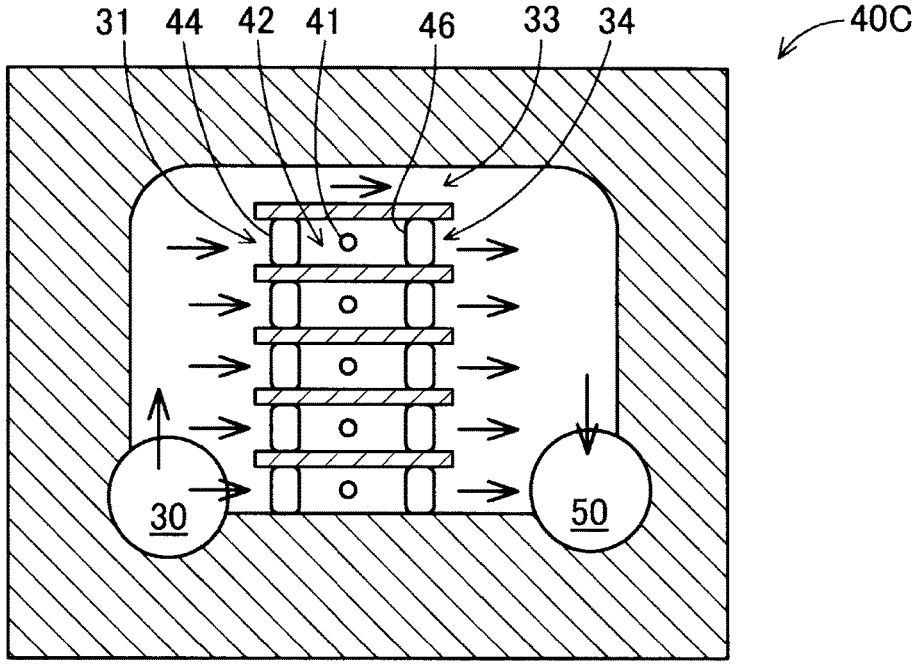
FIG. 7 is a diagram schematically illustrating a structure of a head section according to a third embodiment.

FIG. 7 is a diagram schematically illustrating the structure of a head section 40C according to a third embodiment. The head section 40C according to the third embodiment includes outflow channels 34 as in the second embodiment (FIGS. 5 and 6). In the third embodiment, each outflow channel 34 further includes a second flow path resistance changing device 46 for changing the flow path resistance of the outflow channel 34. The configuration of the second flow path resistance changing device 46 is similar to that of the first flow path resistance changing device 44, and accordingly detailed description will be omitted.

According to the third embodiment, the control unit 80 increases the flow path resistance of the outflow channel 34 in the filling step of filling with liquid (FIG. 4) by controlling the second flow path resistance changing device 46, which enables liquid to be filled in the liquid chamber 42 efficiently. Moreover, in the ejection step of ejecting liquid, the control unit 80 increases the flow path resistance of the outflow channel 34 by controlling the second flow path resistance changing device 46, thereby increasing the pressure within the liquid chamber 42 efficiently. Consequently, liquid can be ejected efficiently. In other steps, the control unit 80 decreases the flow path resistance of the outflow channel 34 by controlling the second flow path resistance changing device 46, which allows the liquid within the liquid chamber 42 to flow into the discharge channel 50. This can restrain sedimentable components of liquid from accumulating within the liquid chamber 42 and can discharge bubbles trapped in the liquid chamber 42 to the discharge channel 50, as in the second embodiment. Clogging or ejection failure of the nozzle 41 can be thereby suppressed.

Fourth Embodiment

Figure 8:
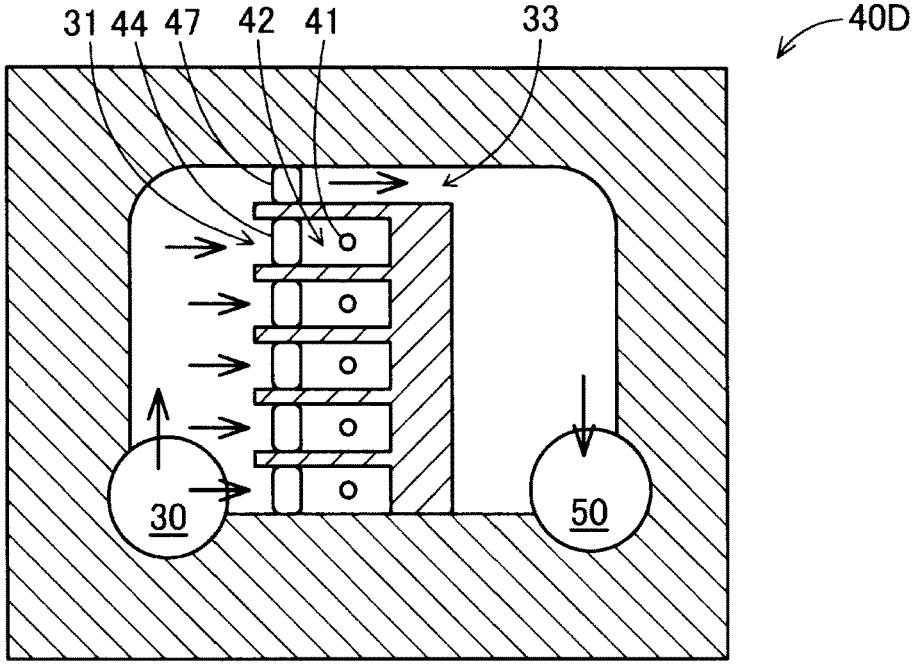
FIG. 8 is a diagram schematically illustrating a structure of a head section according to a fourth embodiment.

FIG. 8 is a diagram schematically illustrating the structure of a head section 40D according to the fourth embodiment.

The head section 40D according to the fourth embodiment includes a third flow path resistance changing device 47 disposed in the bypass channel 33 for changing the flow path resistance of the bypass channel 33. The configuration of the third flow path resistance changing device 47 is similar to that in the first flow path resistance changing device 44, and accordingly detailed description will be omitted.

In the fourth embodiment, the control unit 80 increases the flow path resistance of the bypass channel 33 in the filling step of filling with liquid (FIG. 4), which enables liquid to be filled in the liquid chambers 42 efficiently. In other steps, by reducing the flow path resistance of the bypass channel 33, liquid can be discharged through the bypass channel 33, which enables ejection of a high-viscosity liquid while reducing the likelihood of liquid spilling from the nozzles 41, as in the first embodiment. The third flow path resistance changing device 47 according to the fourth embodiment can be applied to any one of the bypass channels 33 according to the first to third embodiments.

Other Embodiments

In the embodiments described above, the first flow path resistance changing device 44 is disposed in each of the inflow channels 31. However, a single first flow path resistance changing device may be disposed for a plurality of the inflow channels 31, and the flow path resistance of the plurality of the inflow channels 31 may be changed as a whole. In addition, a single second flow path resistance changing device 46 may be disposed for a plurality of the outflow channels 34, and the flow path resistance of the plurality of the outflow channel 34 may be changed as a whole.

In the above embodiments, the head section 40 includes a plurality of the ejection structures. However, the head section 40 may include only one ejection structure.

In the above embodiments, the head section 40 includes a single bypass channel 33. However, the head section 40 may include a plurality of the bypass channels 33.

In the above embodiments, the metering pump is used as the liquid supply section 20. However, the liquid supply section 20 is not limited to the metering pump but any other type of pump, such as one that can supply liquid at a constant pressure, may be adopted.

In the above embodiments, the piezo-actuators are used for the volume changing device 43, the first flow path resistance changing device 44, and the second flow path resistance changing device 46, and the third flow path resistance changing device 47. However, these devices may use, in place of the piezo-actuators, other types of actuators that use, for example, an air cylinder, a solenoid, or a magnetostriction material, or may use cam mechanisms, etc.

Application of the invention is not limited to the liquid ejecting apparatus that ejects ink. The invention can be applied to any type of liquid ejecting apparatus that ejects liquid other than ink. For example, the invention can be applied to the following liquid ejecting apparatuses:

1. a recording apparatus, such as a facsimile;
2. a color material ejecting apparatus that is used in manufacturing color filters for image display apparatuses, such as liquid crystal displays;
3. an electrode material ejecting apparatus that is used for forming electrodes for organic electroluminescence (EL) displays, field emission displays (FED), etc.;
4. a liquid ejecting apparatus that ejects liquid containing a living organic material that is used in manufacturing biochips;
5. a test material ejecting head used as a precision pipette;
6. an ejection apparatus for a lubricant;
7. an ejection apparatus for a resin liquid;
8. a liquid ejecting apparatus that ejects a lubricant at precise positions in a watch, a camera, etc.;
9. a liquid ejecting apparatus that ejects, onto a substrate, a transparent resin liquid such as a liquid of ultraviolet curable resin for forming micro hemispherical lenses (optical lenses) to be used in optical communication elements, etc.;
10. a liquid ejecting apparatus that ejects an acidic or alkaline etchant for etching substrates, etc.; and
11. a liquid ejecting apparatus equipped with a liquid ejecting head that ejects a minute amount of an arbitrary type of droplet.

Note that "liquid droplet" refers to a state of liquid ejected from a liquid ejecting apparatus and includes liquid in a granular state, a tear drop state, or in a state of droplet having a thread-like trail. Also note that "liquid" as used herein refers to a material that can be consumed by a liquid ejecting apparatus. Note that "liquid" as used herein refers to a material that is in a liquid phase, which includes a fluid-state material such as a high viscosity or low viscosity liquid-state material, a sol, gel water, an inorganic solvent, an organic solvent, a solution, a liquid resin, a liquid metal (metallic melt). In addition to liquid-state materials, the term "liquid" encompasses a material made by dispersing, mixing, or solving the particles of a functioning material consisting of solids, such as pigments or metal particles, in a solvent. A typical example of a liquid is ink. The term "ink" encompasses typical water-based or oil-based inks and various liquid composites, such as a gel ink and a hot melt ink.

It should be understood that the invention is not limited to the embodiments described above and various modifications can be made without departing from the scope and spirit of the invention. For example, technical features of the embodiments, which correspond to technical features contained in the forms of the invention described in Summary herein, can be appropriately combined with each other or can be replaced in order to solve a portion or the whole of the above problems or to achieve a portion or the whole of the above advantageous effects. In addition, unless such technical features are described herein as indispensable, such technical features can be appropriately deleted.

The entire disclosure of Japanese Patent Application No.: 2017-145024, filed Jul. 27, 2017 is expressly incorporated by reference herein.

What is claimed is:

1. A liquid ejecting head, comprising:

a plurality of liquid chambers that are in communication with a nozzle that ejects a liquid;

a plurality of volume changing devices that change a volume of the plurality of liquid chambers;

a plurality of inflow channels that are each connected to one of the plurality of liquid chambers and enables the liquid to flow into the respective liquid chambers;

a discharge channel that discharges the liquid and is connected to the plurality of inflow channels;

a plurality of first flow path resistance changing devices disposed in each of the plurality of inflow channels and that change a flow path resistance of a respective inflow channel;

a liquid supply section that supplies the liquid to the plurality of inflow channels by pressurizing the liquid; and a bypass channel that enables the liquid supplied from the liquid supply section to bypass the plurality of inflow channels and to flow into the discharge channel, wherein in a standby step in which the liquid ejecting head does not eject the liquid, the flow path resistance of the bypass channel is lower than a combined flow path resistance of the plurality of inflow channels whose flow path resistance has been changed by the plurality of first flow path resistance changing devices.

2. The liquid ejecting head according to claim 1, further comprising:

an outflow channel that is connected to the liquid chamber and enables the liquid to flow from the liquid chamber to the discharge channel.

3. The liquid ejecting head according to claim 2, further comprising:

a second flow path resistance changing device that changes flow path resistance of the outflow channel.

4. The liquid ejecting head according to claim 1, further comprising:

a third flow path resistance changing device that changes flow path resistance of the bypass channel.

5. The liquid ejecting head according to claim 1, wherein the liquid supply section is a metering pump.

6. A liquid ejecting head, comprising:

a plurality of liquid chambers that are in communication with a nozzle that ejects a liquid;

a plurality of volume changing devices that change a volume of the plurality of liquid chambers;

a supply flow channel that supplies the liquid to each of the plurality of liquid chambers;

a liquid supply section that supplies the liquid to the supply flow channel by pressurizing the liquid;

a plurality of first flow path resistance changing devices that change a flow path resistance;

a discharge flow channel that discharges the liquid; and a bypass channel that connects the plurality of supply flow channels to the discharge flow channel without the plurality of liquid chambers being interposed therebetween, wherein the plurality of first flow path resistance changing devices control flow path resistance of a plurality of fluid channels that are in communication with the plurality of liquid chambers, wherein in a standby step in which the liquid ejecting head does not eject the liquid, the flow path resistance of the bypass channel is lower than a combined flow path resistance of the plurality of fluid channels whose flow path resistance has been changed by the plurality of first flow path resistance changing devices.

* * * * *